US007476111B2

(12) United States Patent
Greenberg

(10) Patent No.: US 7,476,111 B2
(45) Date of Patent: Jan. 13, 2009

(54) TWO-PLUG ELECTRICAL OUTLET WITH DUAL VOLTAGE

(75) Inventor: Michael D. Greenberg, Bloomfield, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/749,876

(22) Filed: May 17, 2007

(65) Prior Publication Data

US 2008/0286995 A1 Nov. 20, 2008

(51) Int. Cl.
*H01R 27/00* (2006.01)

(52) U.S. Cl. ..... 439/107; 439/222

(58) Field of Classification Search ..... 439/107, 439/222; 307/147, 80, 77, 20
See application file for complete search history.

(56) References Cited

U.S. PATENT DOCUMENTS 3,938,068 A * 2/1976 Hagan ..... 337/189
4,019,797 A * 4/1977 Praml ..... 439/107
4,997,381 A 3/1991 Oh
5,379,315 A 1/1995 Meinzer
5,513,998 A 5/1996 Kim
5,533,330 A 7/1996 Mullooly
5,616,051 A 4/1997 Rogers
5,634,806 A 6/1997 Hahn
5,672,066 A * 9/1997 Yeung ..... 439/107
5,791,921 A 8/1998 Lee
5,973,948 A 10/1999 Hahn
6,109,977 A 8/2000 Baxter
6,328,584 B1 * 12/2001 Follett ..... 439/222
6,584,765 B1 7/2003 Tew
6,699,052 B1 3/2004 Poran
6,883,543 B2 4/2005 Tew

* cited by examiner

*Primary Examiner*—Gary F. Paumen
(74) *Attorney, Agent, or Firm*—Carlson, Gaskey & Olds

(57) ABSTRACT

A unique arrangement includes duplex receptacle outlet providing two voltages. A first power wire supplying a first voltage is connected to the receptacle supplying a higher voltage. A second power wire is connected to both receptacles, and a neutral wire is connected to the receptacle supplying a lower voltage. In this manner, a standard electrical outlet need only be modified such that the receptacle has its plug interface modified to receive a standard higher voltage.

15 Claims, 1 Drawing Sheet

TWO-PLUG ELECTRICAL OUTLET WITH DUAL VOLTAGE

BACKGROUND OF THE INVENTION

This application relates to a duplex electrical receptacle that is uniquely configured to provide two levels of voltage power.

Electrical outlets are known, and are provided at various locations in most industrial and residential locations. One standard outlet type is a duplex electrical outlet, receiving two outlets for electrically powered items. These electrical outlets are typically wired to deliver 110 V at each of two plug receptacle locations.

Many machines require 220 V. Thus, separate receptacles or outlets provided with 220 V are also provided. Although 110 V and 220 V are the most common, other voltages are also known.

Some locations, such as a work area, etc. may require both 110 V and 220 V as options. As an example, in a work area, a worker may have certain tools or equipment, such as a room air conditioner, that require 220 V and others that require 110 V. Additionally, during new construction, it may not be known if 220 V or 110 V must be provided for certain appliance installations such as air conditioners or microwave ovens. Further, as can be appreciated, the receptacles 34 and 36 can be utilized simultaneously to provide both voltage levels simultaneously.

To date, to adequately supply the two voltage options, two separate receptacles, with two circuits and two circuit breakers, have typically been required, one connected to 220 V and one connected to 110 V. The duplicate receptacle installations increase both the labor and material costs of the construction.

SUMMARY OF THE INVENTION

In a disclosed embodiment of this invention, a duplex electrical receptacle is provided, with one receptacle delivering a first voltage and the other delivering a second voltage. In a disclosed embodiment, the first voltage is of a voltage twice the second voltage. The first voltage may be 240 or 220 V and the second voltage 120 or 110 V. The shape of the receptacles is such that prong slots are as required for both voltages. While the receptacle could be either of these combinations, the remaining description will discuss the 110/220 V option. It should be understood that all of this description applies equally to 120/240 V combinations.

In the disclosed embodiment, the 220 V is supplied to the electrical outlet through a cable having two power wires, and a neutral wire, as known. An optional ground wire may be provided, also as known. The two power wires each carry 110 V from separate 110 lines in the electrical panel, and are connected to two connections on the receptacle that is to provide 220 V. The other, 110 V, receptacle is connected to the neutral wire, and one of the two power wires. In a disclosed embodiment, a jumper wire or brass tab connects the connection points for each of the receptacles to allow one of the power wires to communicate 110 V to each of the receptacles. The jumper may be formed integrally with the outlet.

A method of providing such an electrical outlet is also disclosed.

These and other features of the present invention can be best understood from the following specification and drawings, the following of which is a brief description.

DETAILED DESCRIPTION OF THE PREFERRED EMBODIMENT

Figure 1:
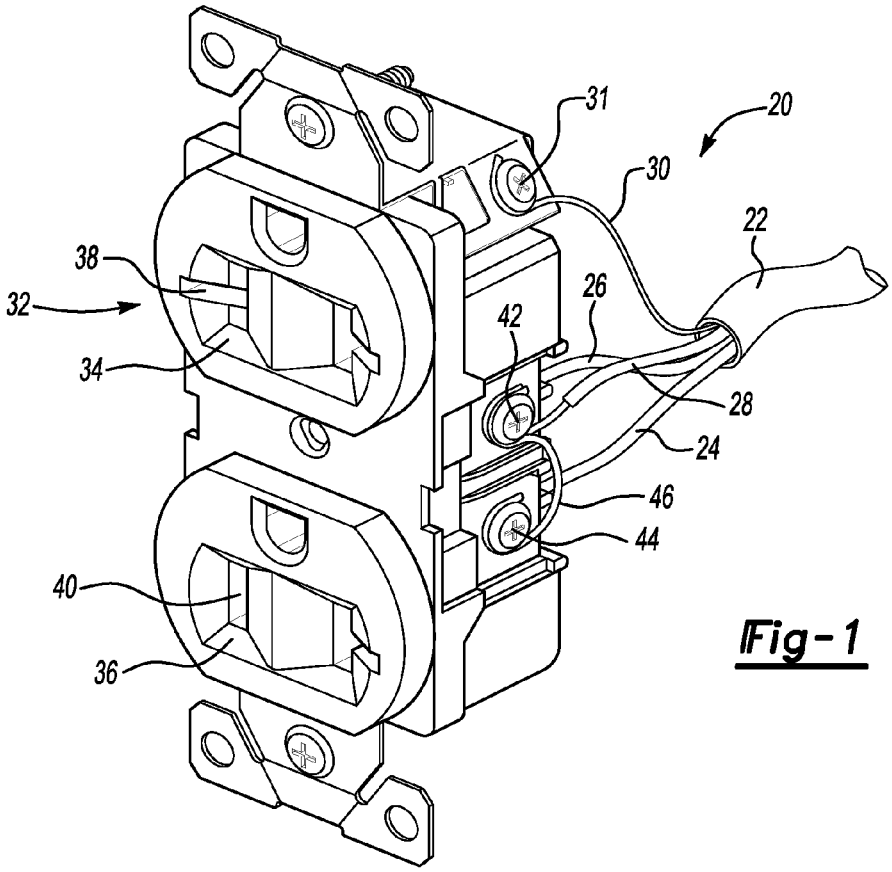
FIG. 1 is a perspective view of an inventive electrical duplex receptacle.

An electrical outlet and cable assembly 20 is illustrated in FIG. 1. A cable 22 carries a white colored neutral wire 24 and two power wires 26 and 28 colored red and black, respectively. Of course, the colors are merely examples. As known, each of the power wires 26 and 28 carry 110 V from separate locations on the electrical panel. A bare copper ground wire 30 is also provided. In some applications, 220 V power can be provided with a cable that does not include the ground wire 30. This invention would extend to the use of such a cable.

The electrical outlet 32 includes two plug receiving receptacles 34 and 36. As shown, the receptacle 34 has one of its prong slots 38 oriented horizontally and one prong slot oriented vertically as is required for a 220 V plug. Slots 40 in the receptacle 36 are both configured vertically for a standard 110 V plug. A standard duplex receptacle electrical outlet can be modified to provide both 220 V and 110 V by changing or modifying the cover plate to one as shown in the figures. Some modification to the internal contacts may also be necessary. On the other hand, some designs may not require internal modifications as they are configured with universal contacts. The electrical outlet 22 can thus be a new manufacture as shown, or a modification of an existing electrical outlet providing duplex 110 V receptacles.

Figure 2:
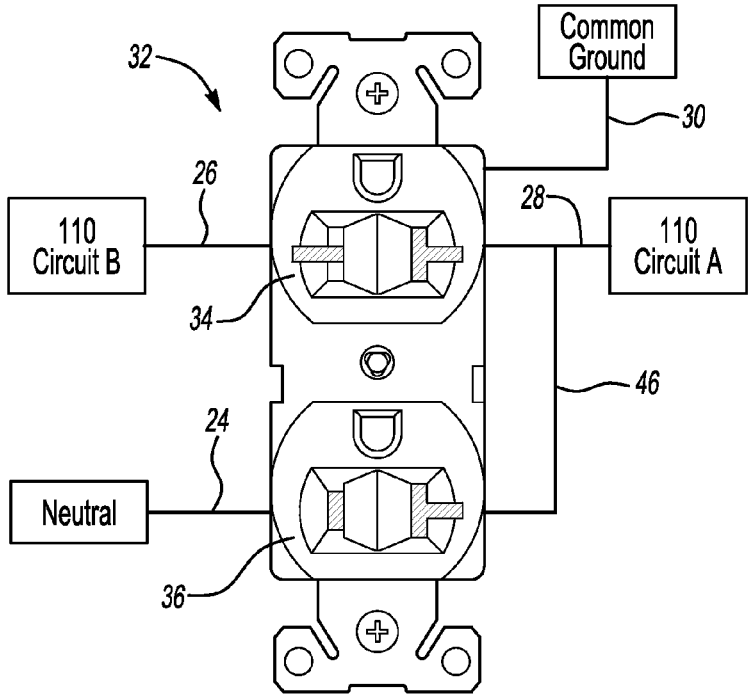
FIG. 2 is a schematic view of the FIG. 1 electrical receptacle.

As shown in FIG. 2, the ground 30 is connected to the ground screw 31 on the receptacle 32. The neutral wire 24 is connected to the screw associated with receptacle 36. The power wire 26 is connected to one of the connection screws associated with the receptacle 34. As can be appreciated from FIG. 1, and as is known in the art, such duplex receptacle electrical outlets have two screw connections on each side, two of which are visible at 42 and 44 in FIG. 1. As shown, the power wire 28 is connected to screw 42. A jumper wire 46 or brass tab then communicates from brass screw 42 to the brass screw 44. In this manner, 110 V from the wire 28 is provided to both receptacles 34 and 36. Power from both wires 24 and 26 is provided to receptacle 34. In this manner, receptacle 34 receives 220 V and receptacle 36 receives 110 V. As can be appreciated, each of the wires may also be back wired to each respective post instead of being side wired to the screws as earlier described.

In practice, the jumper wire 46 might be best used on the side opposite the ground wire 31. That is, for ease of illustration, the wiring has been shown to make all features clear. In practice, the wires 24 and 26 might be attached to the ground screw 31 side, with wire 25 and jumper 46 attached to the other side.

The duplex receptacle may be manufactured for typical 15 or 20 ampere circuits, and the wire may be 12 or 14 gage ROMEX for example.

With the above arrangement, the standard duplex receptacle electrical outlet can easily provide the option of either 110 V or 220 V. Thus, more flexibility is provided to a worker, fewer electrical outlets are required.

While a particular type of duplex receptacle outlet has been illustrated and disclosed, this application would extend to any duplex receptacle electrical outlet. Also, while dual voltage plugs are disclosed, the invention would extend to a duplex receptacle outlet that are configured for plugs of different amperages, for example 15 and 20 amps. The invention could potentially extend to any combination of two distinct voltages selected across this range. The application would extend to both straight blade and locking type plugs. The application would extend to blades with various flat and folded shapes, and grounded and ungrounded plugs. The application would extend to outlets having ground fault circuit interrupt sockets, and any other configuration or type of electrical outlet.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A duplex receptacle electrical outlet comprising:

a pair of receptacle locations, with a first of said receptacle locations being configured to receive a first type standard plug, and a second of the receptacle locations being configured to receive a second type standard plug, and said first and second receptacle locations being capable of being utilized simultaneously; and said first and second standard plug types being for first and second voltages, respectively.

2. The duplex receptacle electrical outlet as set forth in claim 1, wherein said first voltage is twice said second voltage.

3. The duplex receptacle electrical outlet as set forth in claim 2, wherein a cable having at least three wires is connected to supply power to the two receptacles.

4. A duplex receptacle electrical outlet comprising:

a pair of receptacle locations, with a first of said receptacle locations being configured to receive a first type standard plug, and a second of the receptacle locations being configured to receive a second type standard plug, said first and second standard plug types are for first and second voltages, respectively, said first voltage is twice said second voltage;

a cable having at least three wires is connected to supply power to the two receptacles; and a first wire on the cable supplies a neutral path and is connected to the second receptacle, a second wire is to be powered to provide one of 110 and 120 V, and is connected to the first receptacle, and a third wire is to be powered to provide one of 110 and 120 V and is connected to both of the first and second receptacles.

5. The duplex receptacle electrical outlet as set forth in claim 4, wherein a conductor connects the third wire from one of the first and second receptacles to the other of the first and second receptacles.

6. The duplex receptacle electrical outlet as set forth in claim 4,wherein each of said first and second receptacles is provided with two screws to connect the respective wires.

7. The duplex receptacle electrical outlet as set forth in claim 4, wherein a fourth wire is also provided in the cable and used as a ground wire for both receptacles.

8. A method of forming a receptacle electrical outlet comprising the steps of:

providing a pair of receptacle locations, with a first of said receptacle locations being configured to receive a standard plug of a first voltage, and a second of the receptacle locations being configured to receive a standard plug of a second voltage, said first receptacle providing said first voltage into said standard plug simultaneously as said second receptacle providing said second voltage to its standard plug.

9. The method as set forth in claim 8, wherein said first voltage is twice said second voltage.

10. The method as set forth in claim 9, wherein a cable having at least three wires is connected to supply power to the two receptacles.

11. A method of forming a receptacle electrical outlet comprising the steps of:

(a) providing a pair of receptacle locations, with a first of said receptacle locations being configured to receive a standard plug of a first voltage, and a second of the receptacle locations being configured to receive a standard plug of a second voltage, said first voltage is twice said second voltage;

(b) a cable having at least three wires is connected to supply power to the two receptacles, (c) a first wire on the cable supplies a neutral path and is connected to the second receptacle, a second wire is powered to provide one of 110 and 120 V, and is connected to the first receptacle, and a third wire is powered to provide one of 110 and 120 V and is connected to both of the first and second receptacles.

12. The method as set forth in claim 11, wherein a jumper wire connects the third wire from one of the first and second receptacles to the other of the first and second receptacles.

13. The method as set forth in claim 11, each of said first and second receptacles is provided with two screws to connect the respective wires.

14. The method as set forth in claim 11, wherein a fourth wire is also provided in the cable and connected to a ground connection for both receptacles.

15. The method as set forth in claim 8, wherein a standard electrical outlet having two receptacle locations for providing one of 110 and 120 V is modified by replacing a cover plate such that one of the two receptacle locations is now configured to accept one of a 220V and 240 plug.

* * * * *